US010315819B2

(12) United States Patent
Jhu et al.

(10) Patent No.: US 10,315,819 B2
(45) Date of Patent: Jun. 11, 2019

(54) TOOL DISPLAY DEVICE

(71) Applicants: Li-Tang Jhu, Taichung (TW); Ying-Shien Chu, Taichung (TW); Bo-Ming Jhu, Taichung (TW)

(72) Inventors: Li-Tang Jhu, Taichung (TW); Ying-Shien Chu, Taichung (TW); Bo-Ming Jhu, Taichung (TW)

( * ) Notice: Subject to any disclaimer, the term of this patent is extended or adjusted under 35 U.S.C. 154(b) by 469 days.

(21) Appl. No.: 15/136,980

(22) Filed: Apr. 24, 2016

(65) Prior Publication Data

US 2017/0305626 A1 Oct. 26, 2017

(51) Int. Cl.

| | |
|---|---|
| ***B65D 73/00*** | (2006.01) |
| ***B25H 3/00*** | (2006.01) |
| ***B25H 3/04*** | (2006.01) |

(52) U.S. Cl.

CPC ..... *B65D 73/0064* (2013.01); *B25H 3/003* (2013.01); *B25H 3/04* (2013.01)

(58) Field of Classification Search

CPC ..... B65D 73/0064; B25H 3/003

See application file for complete search history.

(56) References Cited

U.S. PATENT DOCUMENTS

| | | | | |
|---|---|---|---|---|
| 5,855,284 | A * | 1/1999 | Dembicks | B25H 3/003 206/378 |
| 6,250,466 | B1 * | 6/2001 | Ernst | B25H 3/003 206/378 |
| 6,273,255 | B1 * | 8/2001 | Rosler | B65D 73/0064 206/378 |
| 6,415,933 | B1 * | 7/2002 | Kao | B25H 3/003 206/378 |
| 6,450,338 | B1 * | 9/2002 | Chen | B25H 3/003 206/378 |
| D722,490 | S * | 2/2015 | Lyons | D8/395 |
| 9,604,771 | B1 * | 3/2017 | Chen | B25H 3/003 |
| 2003/0029756 | A1 * | 2/2003 | Vasudeva | A47F 5/0861 206/379 |
| 2003/0136039 | A1 * | 7/2003 | Su | B25H 3/003 40/673 |
| 2003/0205655 | A1 * | 11/2003 | Chang | A47F 5/0006 248/317 |
| 2005/0230587 | A1 * | 10/2005 | Yang | A47F 5/0006 248/314 |
| 2009/0023328 | A1 * | 1/2009 | Lin | B65D 73/0064 439/387 |
| 2013/0313402 | A1 * | 11/2013 | Lin | F16M 13/02 248/686 |

* cited by examiner

*Primary Examiner* — Anthony D Stashick
*Assistant Examiner* — James R Way

(57) ABSTRACT

A tool display device includes a body having a top portion for being hanged on a wall. A mediate portion is connected to the top portion, and a bottom portion is connected to the meditate portion. A cylindrical connection portion is connected to the bottom portion. A slot is defined through the connection portion and extends from the top of the connection portion and ends before the distal end of the connection portion. An opening is defined in the top of the connection portion and communicates with the slot. The slot divides the connection portion into a left part and a right part. The right part has a protrusion extending from the outside thereof. An restriction member is connected between the mediate portion and the right part. A socket is mounted to the connection portion and can only be removed from the connection portion when the restriction member is cut.

11 Claims, 10 Drawing Sheets

TOOL DISPLAY DEVICE

BACKGROUND OF THE INVENTION

1. Fields of the Invention

The present invention relates to a tool display device, and more particularly, to an anti-theft tool display device.

2. Descriptions of Related Art

The conventional tool display device is disclosed in U.S. Pat. No. 8,181,780 and comprises at least one socket having a shaft with at least one socket groove extending about at least a portion of the shaft radially beyond the shaft. A plurality of posts extend from a base, and each of said posts is connected to respective sockets and has a round cross-section and at least one arm outwardly extends from the base and a radially disposed bead cantileveredly connected thereto. The bead contacts the shaft of a first socket of the at least one socket when placed thereon and then resiliently extending into the socket groove radially beyond the shaft with the bead extending into and cooperating with the socket groove.

However, this disclosure only provide a storage feature and does not have anti-theft feature.

Another similar device is disclosed in U.S. Pat. No. 6,672,555 which discloses a structure of a suspension device and comprises a suspension board having an upper portion formed with a horizontal elongated slot. The suspension board has a bottom edge having a connection plate which is connected to a plate edge of a U-shaped fixing element. The U-shaped fixing element has two lateral sides each provided with a position body configured to engage with a recess of an article.

It is noted that the fixing element is a U-shaped and a square element, when a workpiece is connected to the fixing member, the workpiece cannot be pivoted relative to the fixing element, such that the markings, brand-name, specifications or the like on the workpiece cannot be faced toward a fixed direction. Besides, when multiple workpieces are connected to a tool rack, the brand-name cannot be located in an organized manner.

The present invention intends to provide a tool display device which eliminates the shortcomings mentioned above.

SUMMARY OF THE INVENTION

The present invention relates to a tool display device and comprises a body having a top portion for being hanged on a wall. A mediate portion is connected to the top portion and includes a first face. A bottom portion is connected to the meditate portion and has a cylindrical connection portion. A slot is defined through the connection portion and includes an inclined section which extends from the mediate portion and extends an angle relative to the axis of the connection portion. A horizontal section extends from the lower end of the inclined section. An opening is defined in the top of the connection portion and communicates with the slot. The slot divides the connection portion into a left part and a right part. The right part has a protrusion extending from an outside thereof. A flange extends from each of the left part and the right part. A restriction member is connected between the mediate portion and the right part.

A socket is mounted to the connection portion which resiliently urges the socket. The restriction member has to be cut to squeeze the left and right part to remove the socket from the connection portion.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 3:
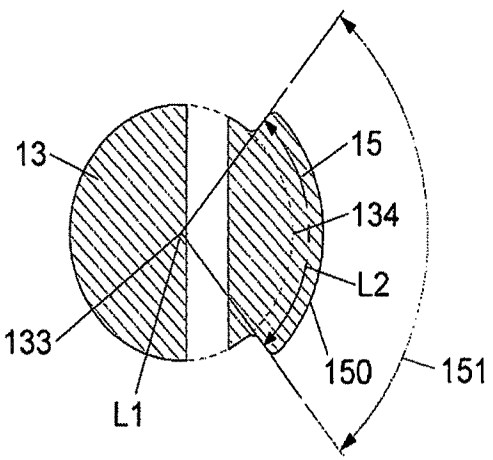
FIG. 3 is an end view taken along line 3-3 in FIG. 2.
Figure 2:
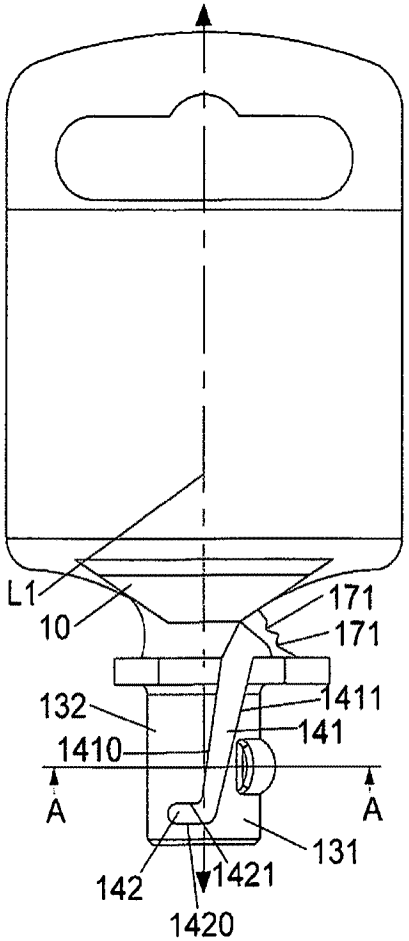
FIG. 2 is a front view to show the tool display device of the present invention.
Figure 1:
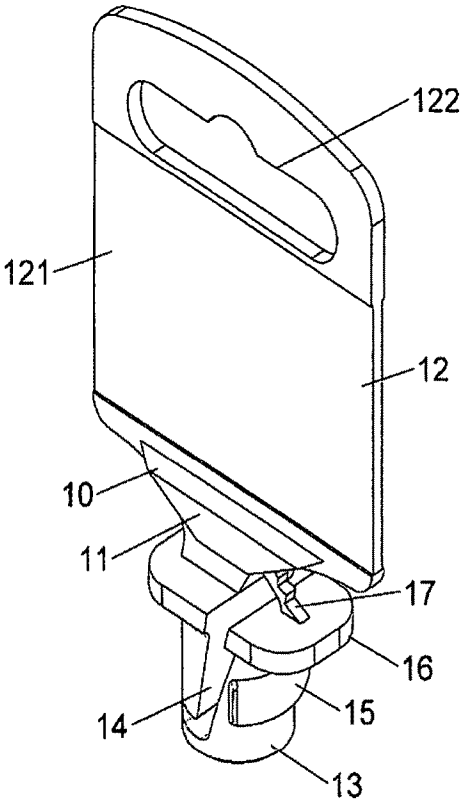
FIG. 1 is a perspective view to show the tool display device of the present invention.

Referring to FIGS. 1 to 3, the tool display device of the present invention comprises a body 10 having a top portion 100, a mediate portion 101 and a bottom portion 102. The top portion 100 is a display member 123 which includes a hole 122 so as to hand the tool display device on a wall. The mediate portion 101 has a first face 11. The bottom portion 102 is a cylindrical connection portion 13 which has a slot 14 defined therethrough. The slot 14 has an inclined section 141 which has two opposite walls 1410/1411 extending from the mediate portion 101 and the two opposite walls 1410/1411 of the inclined section 141 respectively extending a first angle relative to the axis L1 of the connection portion 13. A horizontal section 142 with two opposite walls 1420/1421 horizontally extends from the lower end of the inclined section 141 and is located close to the distal end of the connection portion 13. An opening 144 is defined in the top of the connection portion 13 and communicates with the slot 14. The width of the slot 14 increases from the lower end thereof toward the opening 144. The slot 14 divides the connection portion 13 into a left part 132 and a right part 131, wherein the distal end of the connection member 13 is separated by the slot 14. The right part 131 has a protrusion 15 with a longitudinal line L2 curvedly extending from the outside thereof, and the protrusion 15 has a curved and convex outer surface. The top end 150 of the protrusion 15 curvedly extending relative to the axis L1 of the cylindrical connection portion 13.

As shown in FIG. 3, the connection portion 13 has a center 133 which is located corresponding to a peripheral arc 134 as shown, and an angle 151 is defined between two imaginary lines that pass through two ends of the protrusion 15 and the center 133 of the connection portion 13. The angle 151 is in a range between 30 to 150 degrees, preferably, between 80 to 100 degrees, or between 50 to 120 degrees.

A flange 16/160 extends horizontally from the top of each of the left part 132 and the right part 131, and the two flanges 16, 160 share a common horizontal plane. A restriction member 17 is connected between the mediate portion 101 and the right part 131. The thickness of the restriction member 17 is smaller that of the mediate portion 101. Two V-shaped notches 171 are defined in the outside of the restriction member 17. The display member 123, the first face 11, the connection portion 13, the protrusion 15, the flanges 16, 160 and the restriction member 17 are an integral piece and made by plastic or rubber.

The display member 123 is a board 12 which has a second face 121. The direction that the second face 121 faces and the direction that the first face 11 faces are the same. Besides, the direction that the slot 14 is formed through the connection portion 13 and the direction that the first face 11 faces are perpendicular to each other. The brand name, the specifications of the socket or other information are located corresponding to the second face 121, this makes the sockets 20 and the boards 12 look organized.

Figure 4:
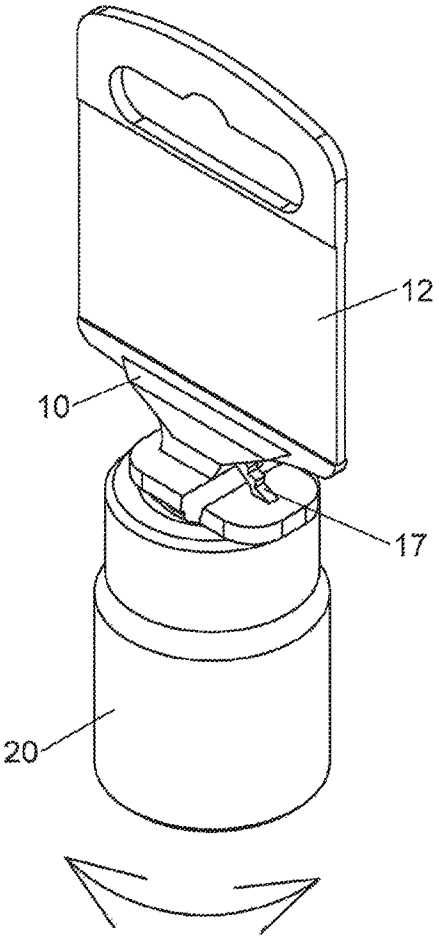
FIG. 4 shows that a socket is rotatably mounted to the connection portion of the tool display device of the present invention.

As shown in FIG. 4, the socket 20 is forced to be mounted to the connection portion 13, and the socket 20 is rotatable relative to the connection portion 13. The top of the socket 20 contacts the flanges 16, 160, and the protrusion 15 urges the inside of the socket 20. The restriction member 17 is exposed beyond the top of the socket 20 and is restricted by the first face 11, so that the socket 20 cannot be removed from the connection portion 13.

Figure 5:
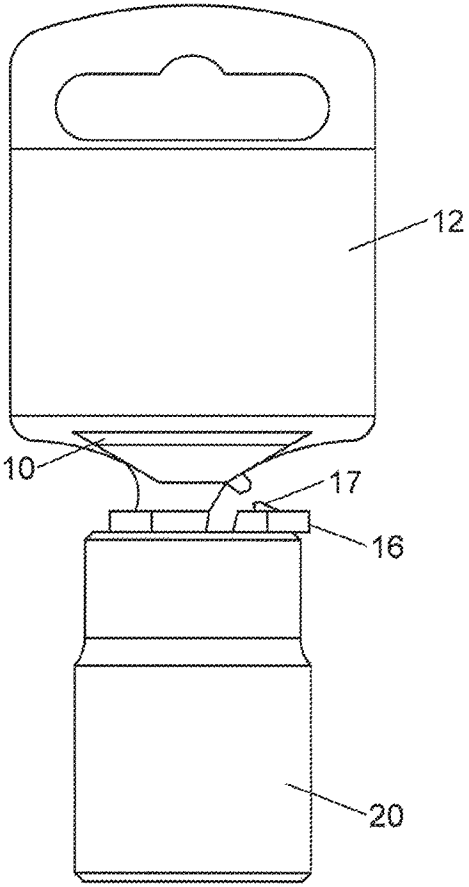
FIG. 5 shows that the restriction member is cut.

As shown in FIG. 5, when removing the socket 20 from the connection portion 13, the restriction member 17 is cut from the notches 171, so that the right part 131 is allowed to be moved toward the left part 132, so that the protrusion 15 is moved inward and away from an engaging slot in the inside of the socket 20. The socket 20 can be removed from the connection portion 13. After the restriction member 17 is cut, the connection portion 13 is still connected with the display member 123, and the protrusion 15 is still able to be engaged with the engaging slot in the inside of the socket 20, so that the socket 20 may still be connected to the connection portion 13 when needed.

Figure 6:
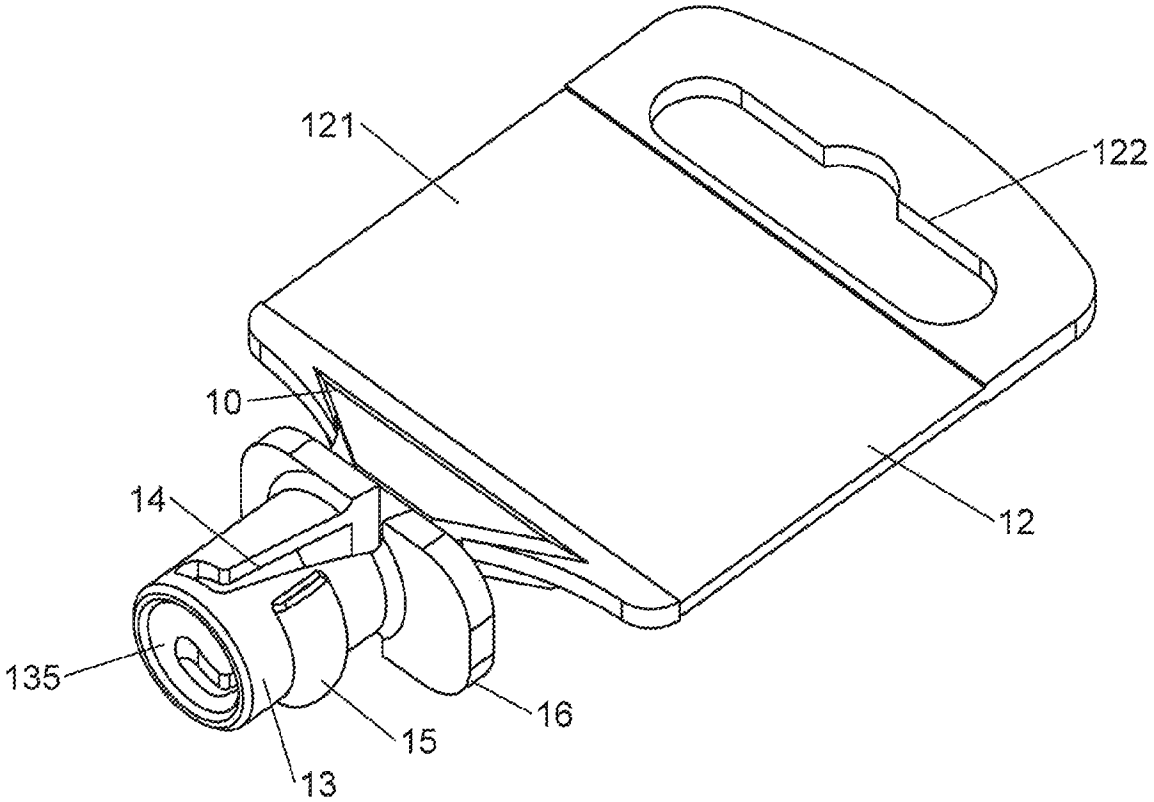
FIG. 6 is a perspective view to show the second embodiment of the tool display device of the present invention.

As shown in FIG. 6, the connection portion 13 has an axial recess 135 defined axially in the underside thereof so that the connection portion 13 is a hollow portion and includes a thin wall to reduce weight and cost.

Figure 8:
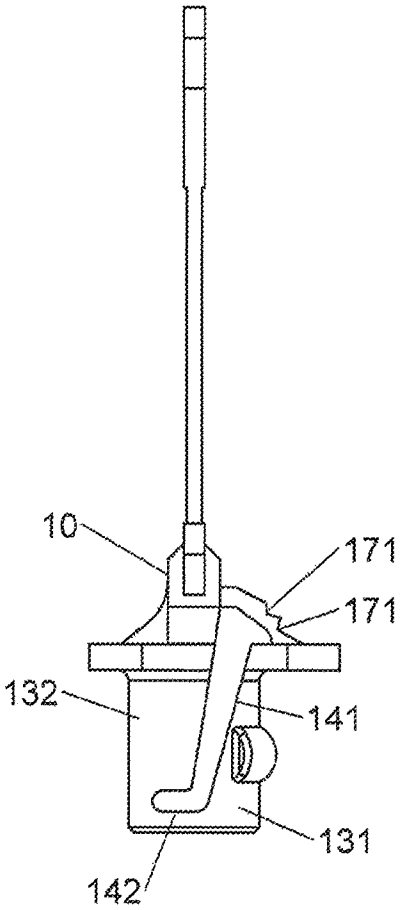
FIG. 8 is a side view of the third embodiment of the tool display device of the present invention.
Figure 7:
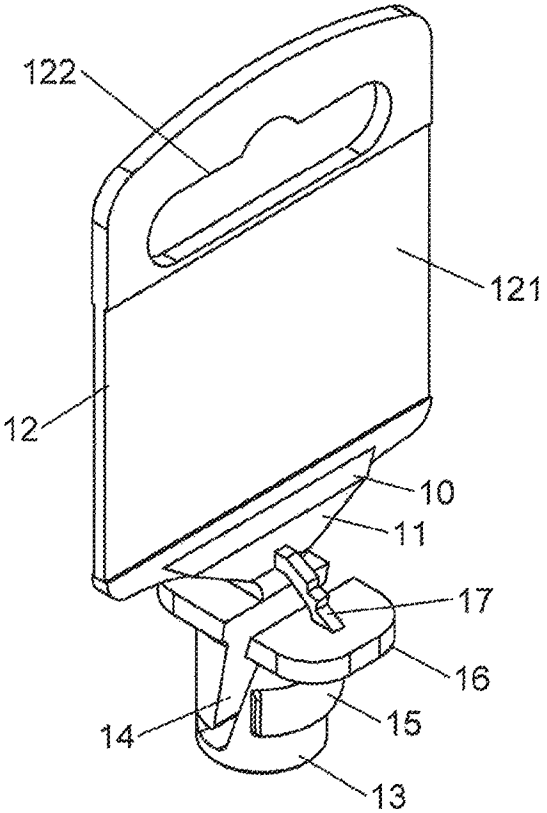
FIG. 7 is a perspective view to show the third embodiment of the tool display device of the present invention.

FIGS. 7 and 8 show that the direction that the slot 14 is formed through the connection portion 13 is parallel to the first face 11.

Figure 9:
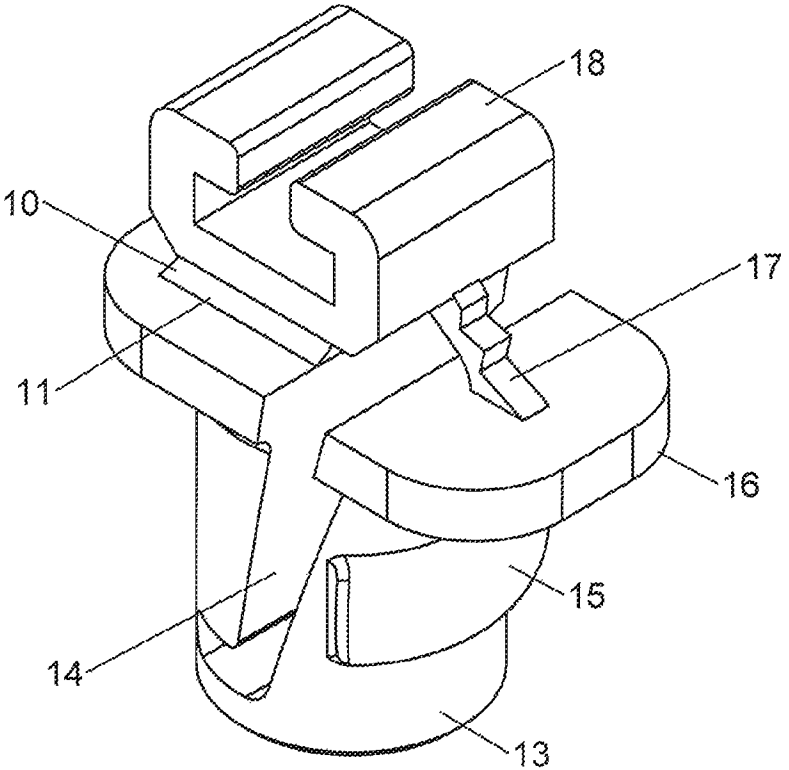
FIG. 9 is a perspective view to show the fourth embodiment of the tool display device of the present invention.
Figure 10:
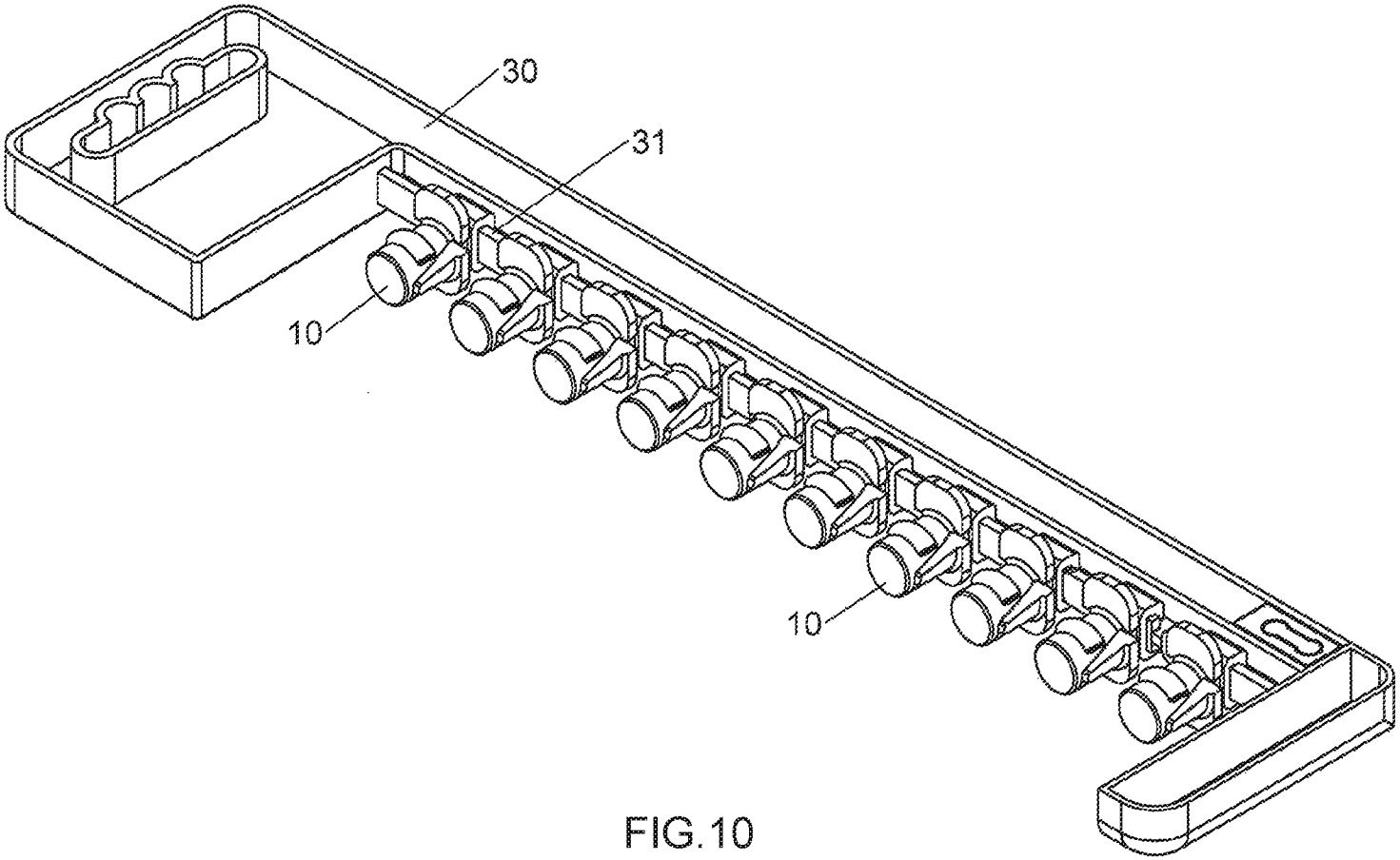
FIG. 10 is a perspective view to show that multiple the fourth embodiments of the tool display device of the present invention are connected to a rack.
Figure 11:
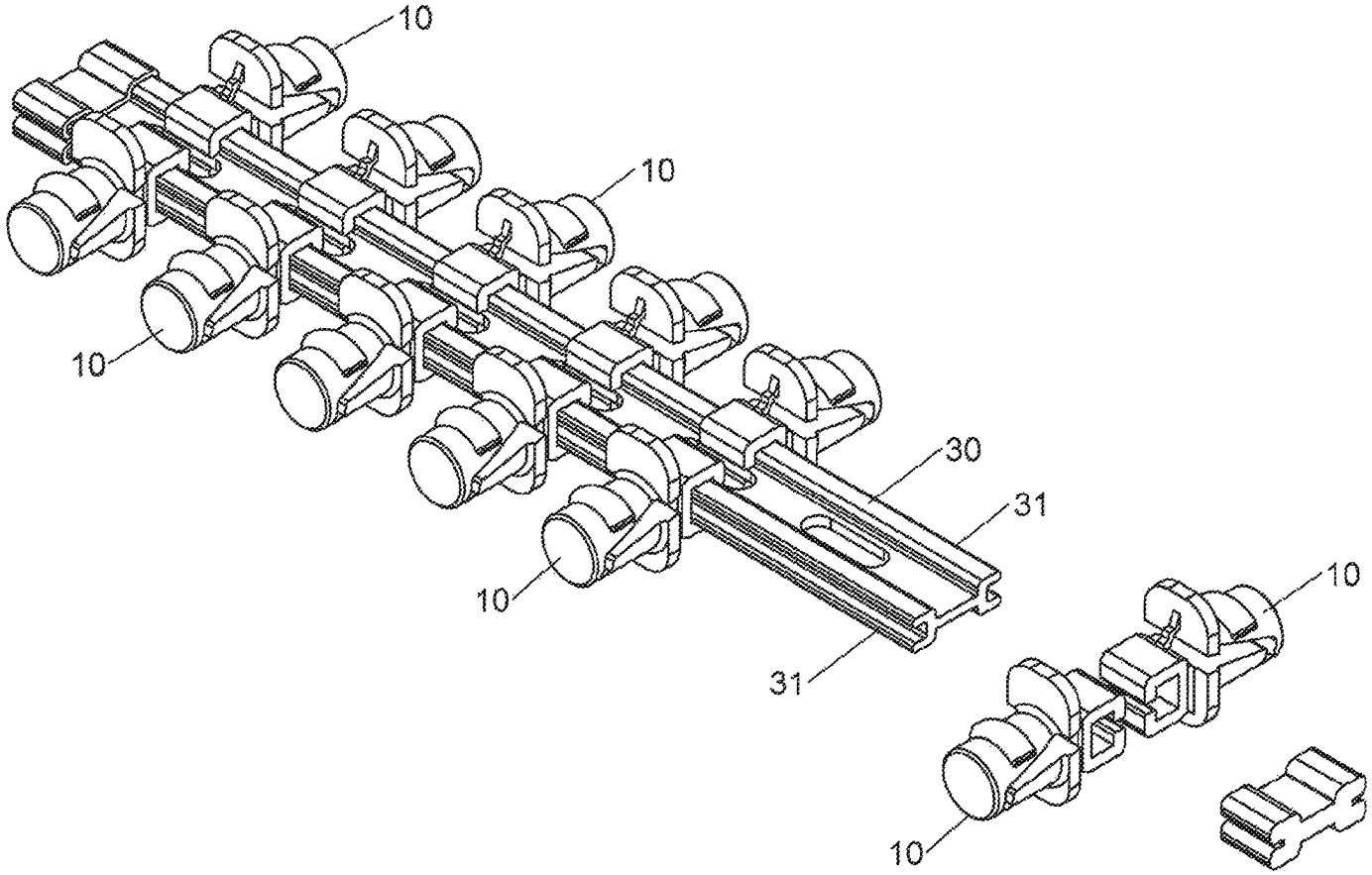
FIG. 11 is a perspective view to show the fifth embodiment of the tool display device of the present invention.

As shown in FIGS. 9 and 10, the display member 123 has a T-shaped first rail 18, and a rack 30 has a T-shaped second rail 31 with which the first rail 31 is slidably engaged. As shown in FIG. 11, the rack 30 has a Y-shaped second rail 31, and the T-shaped first rail 18 is slidably engaged with the second rail 31.

Figure 13:
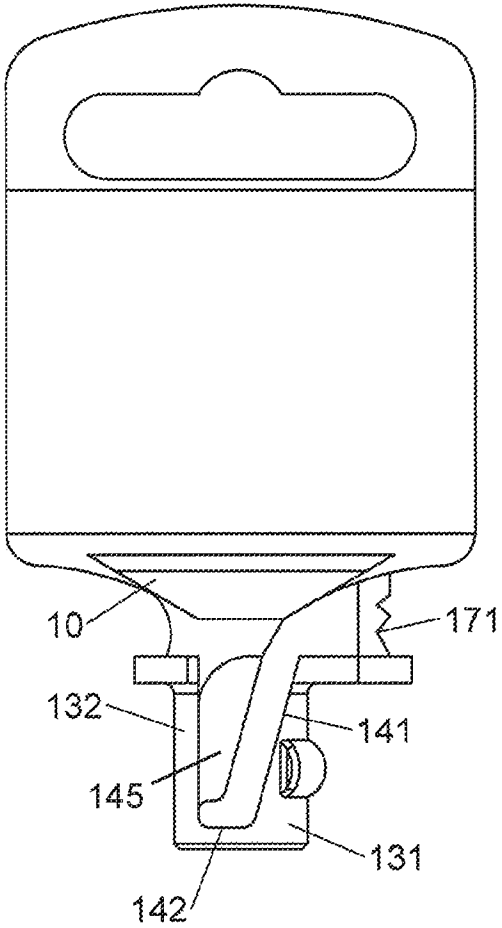
FIG. 13 is a top view to show the sixth embodiment of the tool display device of the present invention.
Figure 12:
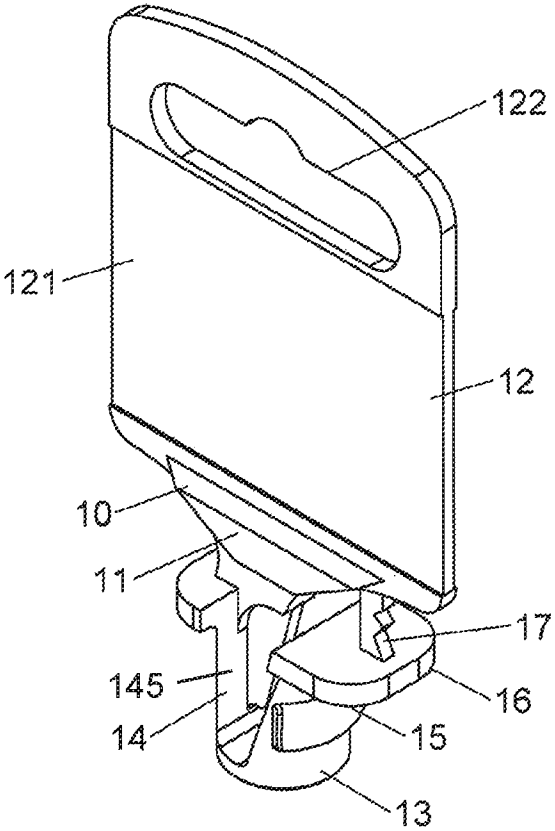
FIG. 12 is a perspective view to show the sixth embodiment of the tool display device of the present invention.

As shown in FIGS. 12 and 13, the slot 14 has a recessed area 145 defined in one of two insides thereof, and the restriction member 17 is perpendicularly connected to the top of the flange 16.

Figure 15:
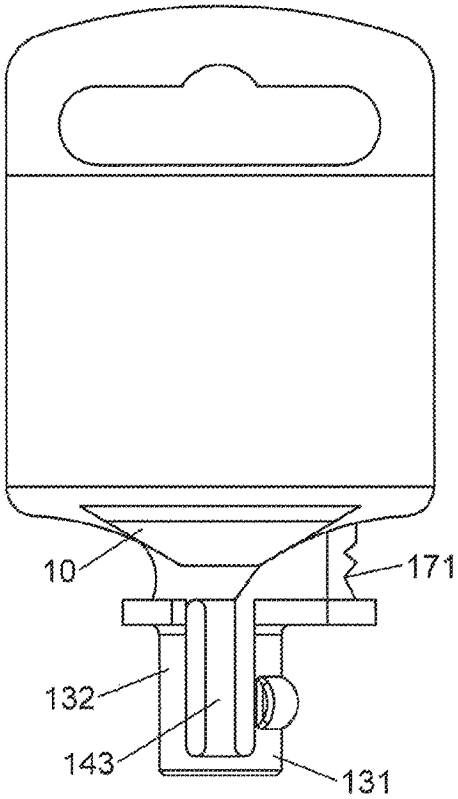
FIG. 15 is a top view to show the seventh embodiment of the tool display device of the present invention.
Figure 14:
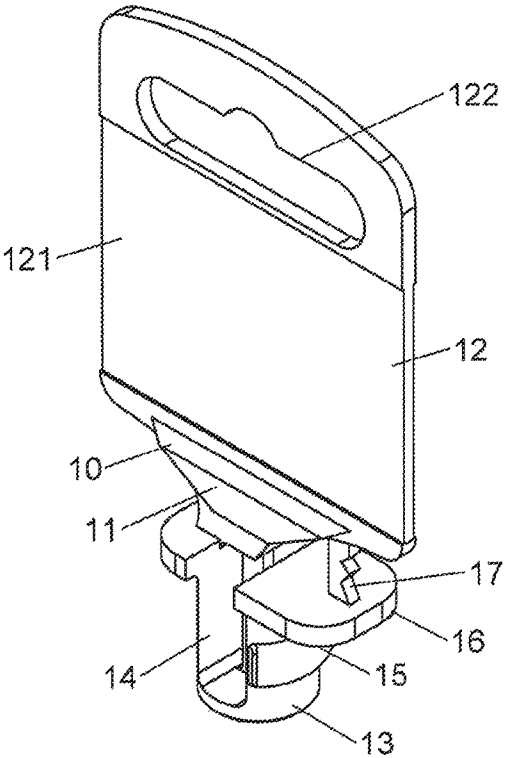
FIG. 14 is a perspective view to show the seventh embodiment of the tool display device of the present invention.

As shown in FIGS. 14 and 15, the slot 14 has a rib 143 formed axially therein, and two ends of the rib 143 are respectively connected to the mediate portion 101 and the lower end of the slot 14.

Figure 16:
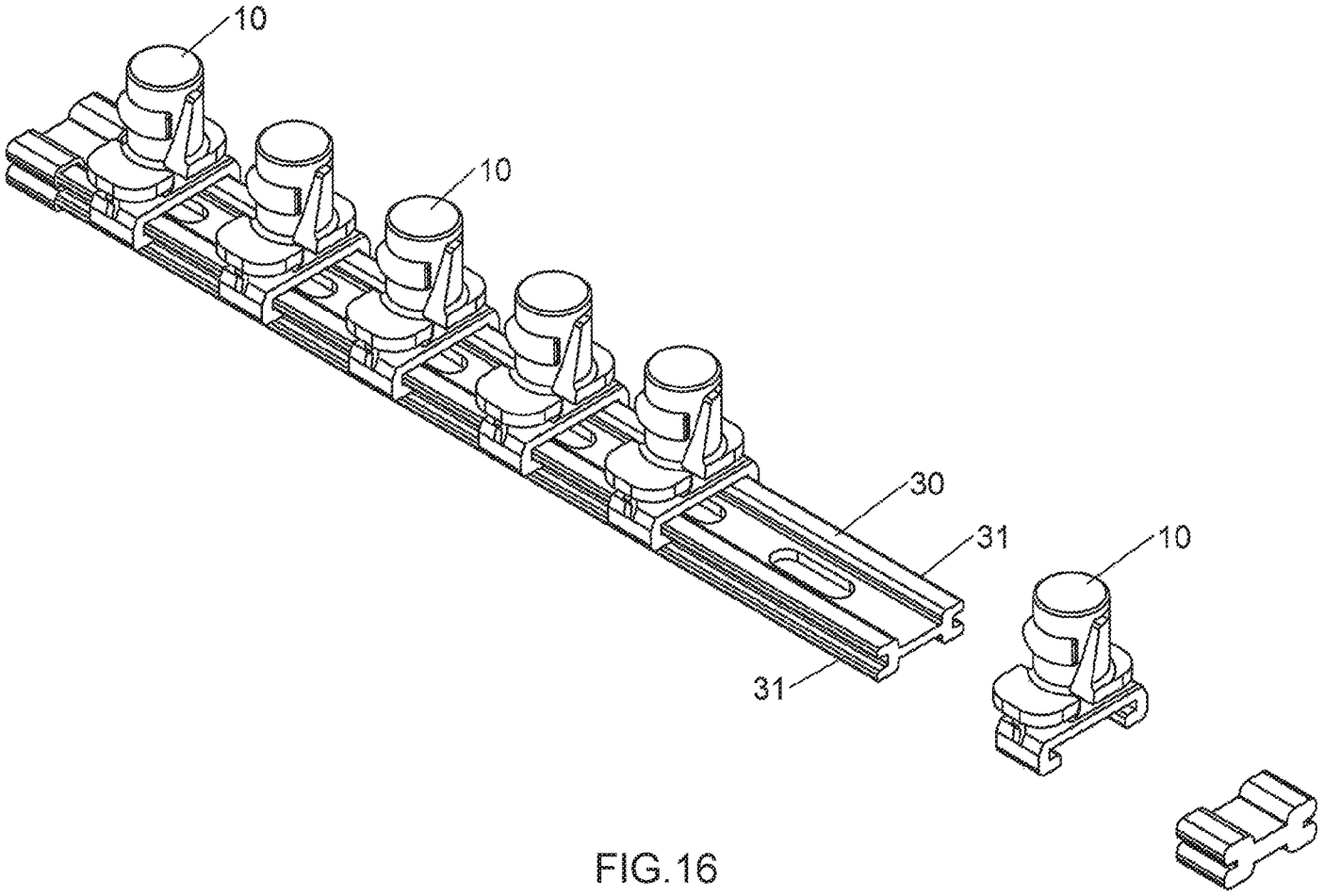
FIG. 16 is a perspective view to show the eighth embodiment of the tool display device of the present invention.

FIG. 16 shows that multiple bodies 10 are connected to the rack 30 by the first rails 18 and the second rail 31.

The advantages of the present invention are that the cross section of the connection portion 13 is a circular area so that the socket 20 can be rotatable relative to the connection portion 13. The brand name, the specifications of the socket or other information are located corresponding to the second face 121, this makes the sockets 20 and the boards 12 look organized.

When multiple bodies 10 are connected to the rack 30, because the sockets 20 can be rotated, so that all of the brand name, the specifications of the socket or other information are arranged to face the same direction.

The restriction member 17 is exposed beyond the top of the socket 20 and is restricted by the first face 11, so that the socket 20 cannot be removed from the connection portion 13.

The flange 16 are exposed beyond the socket 20 so that when pushing the flange 16 downward, the protrusion 15 is moved inward to easily remove the socket 20 from the connection portion 13.

The restriction member 17 is cut to allow the protrusion 15 to be moved inward to assist the removal of the socket 20 from the connection portion 13.

The present invention can be re-used because after the restriction member 17 is cut, the connection portion 13 is still connected with the display member 123, and the protrusion 15 is still able to be engaged with the engaging slot in the inside of the socket 20, so that the socket 20 may still be connected to the connection portion 13 when needed.

While we have shown and described the embodiment in accordance with the present invention, it should be clear to those skilled in the art that further embodiments may be made without departing from the scope of the present invention.

What is claimed is:

1. A tool display device comprising:

a body having a top portion, a mediate portion and a bottom portion, the top portion being a display member, the mediate portion having a first face, the bottom portion being a cylindrical connection portion which has a slot defined therethrough, the slot having an inclined section which has two opposite walls extending from the mediate portion and the two opposite walls of the inclined section respectively extending a first angle relative to an axis of the cylindrical connection portion, a horizontal section which has two opposite walls horizontally extending from a lower end of the inclined section and located close to a distal end of the connection portion, an opening defined in a top of the connection portion and communicating with the slot, the slot dividing the connection portion into a left part and a right part, the right part having a protrusion with a longitudinal line curvedly extending from an outside thereof, a top end of the protrusion curvedly extending relative to the axis of the cylindrical connection portion, an second angle defined between two imaginary lines that pass through two ends of the protrusion and a center of the connection portion, the second angle being in a range between 30 to 150 degrees, a flange extending horizontally from a top of each of the left part and the right part, the two flanges sharing a common horizontal plane, a restriction member connected between the mediate portion and the right part, a thickness of the restriction member being smaller that of the mediate portion, at least one notch defined in an outside of the restriction member, the display member, the first face, the connection portion, the protrusion, the flanges and the restriction member being an integral piece and made by plastic or rubber.

2. The tool display device as claimed in claim 1, wherein a direction that the slot is formed through the connection portion and a direction of the first face are perpendicular to each other.

3. The tool display device as claimed in claim 1, wherein the second angle is between 50 to 120 degrees.

4. The tool display device as claimed in claim 1, wherein the second angle is between 80 to 120 degrees.

5. The tool display device as claimed in claim 1, wherein a number of the at least one engaging notch is two.

6. The tool display device as claimed in claim 1, wherein the display member is a board which has a second face, a direction that the second face faces and a direction that the first face faces are the same.

7. The tool display device as claimed in claim 1, wherein the connection portion has an axial recess defined axially in an underside thereof so that the connection portion is a hollow portion.

8. The tool display device as claimed in claim 1, wherein a direction that the slot is formed through the connection portion is parallel to the first face.

9. The tool display device as claimed in claim 1, wherein the display member has a first rail, a rack has a second rail with which the first rail is slidably engaged.

10. The tool display device as claimed in claim 1, wherein a width of the slot increases from a lower end thereof toward the opening.

11. The tool display device as claimed in claim 1, wherein the protrusion has a curved and convex outer surface.

* * * * *